US006084171A

United States Patent [19]

Kay

[11] Patent Number: 6,084,171

[45] Date of Patent: Jul. 4, 2000

[54] METHOD FOR DYNAMICALLY ASSEMBLING A CONVERSION TABLE

[76] Inventor: Stephen R. Kay, 140 Madison Ave., Westfield, N.J. 07090

[21] Appl. No.: 09/238,801

[22] Filed: Jan. 28, 1999

Related U.S. Application Data

[60] Provisional application No. 60/072,920, Jan. 28, 1998.

[51] Int. Cl.[7] ..... G10H 1/38; G10H 7/00

[52] U.S. Cl. ..... 84/613; 84/637

[58] Field of Search ..... 84/613, 637, 645

[56] References Cited

U.S. PATENT DOCUMENTS

| | | | |
|---|---|---|---|
| 3,877,337 | 4/1975 | Obayashi et al. | 84/1.01 |
| 3,971,282 | 7/1976 | Obayashi et al. | 84/1.01 |
| 4,011,784 | 3/1977 | Fukui | 84/1.01 |
| 5,078,040 | 1/1992 | Shibukawa | 84/619 |
| 5,099,738 | 3/1992 | Hotz | 84/617 |
| 5,322,966 | 6/1994 | Shimaya | 84/613 X |
| 5,502,274 | 3/1996 | Hotz | 84/613 |
| 5,521,327 | 5/1996 | Kay et al. | 84/635 |
| 5,563,361 | 10/1996 | Kondo et al. | 84/613 X |
| 5,612,501 | 3/1997 | Kondo et al. | 84/637 |
| 5,619,003 | 4/1997 | Hotz | 84/615 |
| 5,864,079 | 1/1999 | Matsuda | 87/619 |

*Primary Examiner*—Jeffrey Donels

*Attorney, Agent, or Firm*—Lerner, David, Littenberg, Krumholz & Mentlik, LLP

[57] ABSTRACT

Conversion of input notes to a scale corresponding to a desired chord may be achieved using dynamic conversion apparatus and methods and possibly including overrides for non-chordal tones, instead of fixed, dedicated tables for each chord type. Conversion of input notes to output notes corresponding to a desired conversion map may also be achieved using dynamic conversion apparatus and methods instead of fixed, dedicated tables for each map. Both result in a savings of memory and effort, and greater diversity of control.

34 Claims, 8 Drawing Sheets

| CHORD | 1 | 2 | 3 | 4 | 5 | 6 | 7 |
|---|---|---|---|---|---|---|---|
| Maj | 1 | 1 | 1 | 2 | 1 | 2 | 2 |
| Maj6 | 1 | 1 | 1 | 2 | 1 | 2 | 2 |
| Maj7 | 1 | 1 | 1 | 2 | 1 | 2 | 0 |
| Maj7b5 | 1 | 1 | 1 | 1 | 0 | 4 | 0 |
| Maj7sus4 | 1 | 3 | 3 | 3 | 1 | 2 | 0 |
| Min | 1 | 0 | 0 | 3 | 1 | 1 | 1 |
| Min6 | 1 | 0 | 0 | 3 | 1 | 2 | 2 |
| Min7 | 1 | 0 | 0 | 3 | 1 | 1 | 1 |
| Min7b5 | 0 | 0 | 0 | 4 | 0 | 3 | 1 |
| MnMj7 | 1 | 0 | 0 | 3 | 1 | 1 | 0 |
| 7th | 1 | 1 | 1 | 2 | 1 | 5 | 1 |
| 7b5 | 1 | 1 | 1 | 1 | 0 | 3 | 1 |
| 7sus4 | 1 | 3 | 3 | 3 | 1 | 5 | 1 |
| Sus4 | 1 | 3 | 3 | 0 | 1 | 2 | 2 |
| Sus2 | 1 | 2 | 2 | 3 | 1 | 2 | 2 |
| Dim | 0 | 0 | 0 | 1 | 0 | 4 | 2 |
| DimMj7 | 0 | 0 | 0 | 1 | 0 | 4 | 0 |
| Aug | 1 | 1 | 1 | 1 | 2 | 0 | 1 |
| Aug7 | 1 | 1 | 1 | 1 | 2 | 0 | 1 |
| AugMj7 | 1 | 1 | 1 | 1 | 2 | 0 | 0 |

700

FRAGMENTS

| MAP | 1 | 2 | 3 | 4 |
|---|---|---|---|---|
| 1 | 0 | 0 | 0 | 0 |
| 2 | 1 | 0 | 0 | 0 |
| 3 | 2 | 0 | 0 | 0 |
| 4 | 3 | 0 | 0 | 0 |
| 5 | 0 | 1 | 0 | 0 |
| 6 | 0 | 2 | 0 | 0 |
| 7 | 0 | 3 | 0 | 0 |
| 8 | 0 | 4 | 0 | 0 |
| 9 | 0 | 0 | 1 | 0 |
| 10 | 0 | 0 | 2 | 0 |
| 11 | 0 | 0 | 0 | 1 |
| 12 | 0 | 0 | 0 | 2 |
| 13 | 1 | 1 | 0 | 0 |
| 14 | 2 | 1 | 0 | 0 |
| 15 | 3 | 1 | 0 | 0 |
| 16 | 1 | 2 | 0 | 0 |
| 17 | 2 | 2 | 0 | 0 |
| 18 | 3 | 2 | 0 | 0 |
| 19 | 1 | 3 | 0 | 0 |
| 20 | 2 | 3 | 0 | 0 |
| 21 | 3 | 3 | 0 | 0 |
| 22 | 1 | 4 | 0 | 0 |
| 23 | 2 | 4 | 0 | 0 |
| 24 | 3 | 4 | 0 | 0 |
| 25 | 0 | 4 | 1 | 0 |
| 26 | 0 | 4 | 2 | 0 |
| 27 | 0 | 4 | 1 | 1 |
| 28 | 0 | 4 | 2 | 1 |
| 29 | 0 | 4 | 1 | 2 |
| 30 | 0 | 4 | 2 | 2 |

710

730

720

FRAGMENT SELECTIONS

FIG. 7

METHOD FOR DYNAMICALLY ASSEMBLING A CONVERSION TABLE

The present application claims benefit of United States Provisional Patent Application 60/072,920, filed on Jan. 28, 1998, the disclosure of which is incorporated by reference herein.

FIELD OF THE INVENTION

The present invention relates generally to apparatus and methods of music creation. Particularly, the present invention is directed to apparatus and methods for taking an input set of notes from a musical input source and creating a set of output notes based on the use of a conversion table such that the set of output notes is one of a plurality of chords or conversion maps.

BACKGROUND AND OBJECTS OF THE INVENTION

The use of conversion tables in musical inventions is well known. The Korg i-3 auto-accompaniment keyboard is one example of a product employing such tables. Like other auto-accompaniment type keyboards, the Korg i-3 performs chord analysis on the notes played by the user in a control area of the keyboard, determines a chord for the input notes, and selects a conversion table from a plurality of stored conversion tables, stored in the keyboard's electronic memory, so as to conform the resultant output notes to a predetermined chord. For example, a look-up table can be utilized in this fashion, which takes selected notes in a given chord as inputs and generates output notes that are within a scale corresponding to the input chord. The conversion table is thus used to transpose the notes of input musical material, in real-time, into a different output key or tonality.

Typically, the above conversion tables are provided for only 10–20 chords, with each of the conversion tables having fixed values. Memory requirements and the time-consuming operations of creating, testing, and maintaining these tables typically preclude a greater number of chord types from being made available. However, thousands of input chords are possible within music when all of the different scale tones which may be added to traditionally recognized chords are considered. Some of these additional tones are referred to as tensions, examples of which are a flat ninth (♭9), a ninth (9th), a sharp ninth (♯9), an eleventh (11) a sharp eleventh (♯11), a thirteenth (13), and a flat thirteenth (♭13). Many of these tensions can be combined within the same chord. Thus, having a conversion table for each chord and combination of tensions is both memory intensive and difficult to manage.

Another disadvantage of prior art table lookup methods is that predetermined decisions are made as to which notes are valid for a given chord, including tension types. Occasionally, the user may wish to allow "non-chordal" tones (i.e. tones not within the chord or scale or which are not considered to be valid tensions). For example, the chord CMaj7 typically has no provision for allowing an A♯ to be present in the scale. In such prior art methods, the presence of the A♯ is generally not acknowledged, and there is no way for the user to obtain an A♯ in the resulting output material even if desired, since no provisions are made for it in a conversion table.

Conversion tables are not limited to being used to constrain pitches to desired chord types or scales. U.S. Pat. No. 5,521,327, issued to Kay ct al., shows means for selectively changing drum notes to other drum notes using a plurality of fixed conversion tables, often referred to as conversion maps. However, if the number of drum notes to be changed is very large, the size of each table grows, thereby increasing the number of desired conversion maps, the number of drum notes, table memory usage and overall table maintenance complexity.

SUMMARY OF THE INVENTION

The apparatus of the invention includes a computer-based musical conversion system for converting musical notes comprising a musical input device, a musical output device, and a set of available input notes from the musical input device. The apparatus further includes a set of input notes comprising a subset of the set of available input notes; a set of available output notes and a set of fragments. Each of the fragments contains at least one note of the set of input notes. The invention includes a fragment selection table including at least one fragment selection set for each fragment. Each of the fragment selection sets comprise notes of the set of available set of output notes wherein each first subset input note of the fragments is correlated with exactly one of the set of available output notes within each of the fragment selection sets. Also included is a fragment selection matrix including at least one map of valid fragment selections and each of the valid fragment selections indicate one of the fragment selection sets for each of the fragments. Further included is a map selector for selecting the map and a set of selected output notes which comprise a subset of the set of available output notes resulting from the selection of one of the maps. The set of selected output notes are applied to the musical output device in response to the set of input notes applied to the musical input device.

The method of the present invention includes the steps of applying a set of input notes to a musical input, dividing the set of input notes into fragments, each of the fragments including at least one note of the input set of notes and creating at least one fragment selection set for each of the fragments. Further included are steps for mapping an output note within each fragment selection set to each of the input notes of the associated fragments, creating a fragment selection matrix including at least one map, the map including a set of valid fragment selections, each of the valid fragment selections indicating one of the fragment selection sets for each of the fragments, and selecting one of the maps so as to determine a set of selected output notes. Finally the step of applying the selected set of output notes to a musical output in response to the set of input notes is included.

Further provided by the present invention is a computer-readable medium for storing a set of instructions for controlling a general purpose digital computer including the set of instructions for causing the computer to accept a set of input notes from a musical input; divide the set of input notes into fragments, each of the fragments including at least one note of the input set of notes, and create at least one fragment selection set for each of the fragments. The computer readable medium also has instructions to map an output note within each fragment selection set to each of the input notes of the associated fragments, create a fragment selection matrix including at least one map, the map including a set of valid fragment selections, each of the valid fragment selections indicating one of the fragment selection sets for each of the fragments; select one of the maps so as to determine a set of selected output notes, and apply the selected set of output notes to a musical output in response to the set of input notes.

Therefore, it is an object of the present invention to provide methods and apparatus for the conversion of a large number of input chords without having to provide a fixed, dedicated table for each chord. Further, it is desirable to provide greater conversion flexibility in allowing non-chordal tones, tensions, and various combinations thereof in the musical output material. It is still another object of the invention to offer musical conversion methods and apparatus which include a large number of conversion maps without having to provide a fixed, dedicated table for each conversion map. These results are accomplished in the present invention by utilizing a "dynamic conversion table" composed of smaller conversion components, which optionally includes an override system, to provide better recognition of chord types, a greater number of conversion maps, and better memory usage.

BRIEF DESCRIPTION OF THE DRAWINGS

FIG. 7 shows a table of conversion maps and their respective fragment selections.

DETAILED DESCRIPTION OF THE INVENTION

Figure 1:
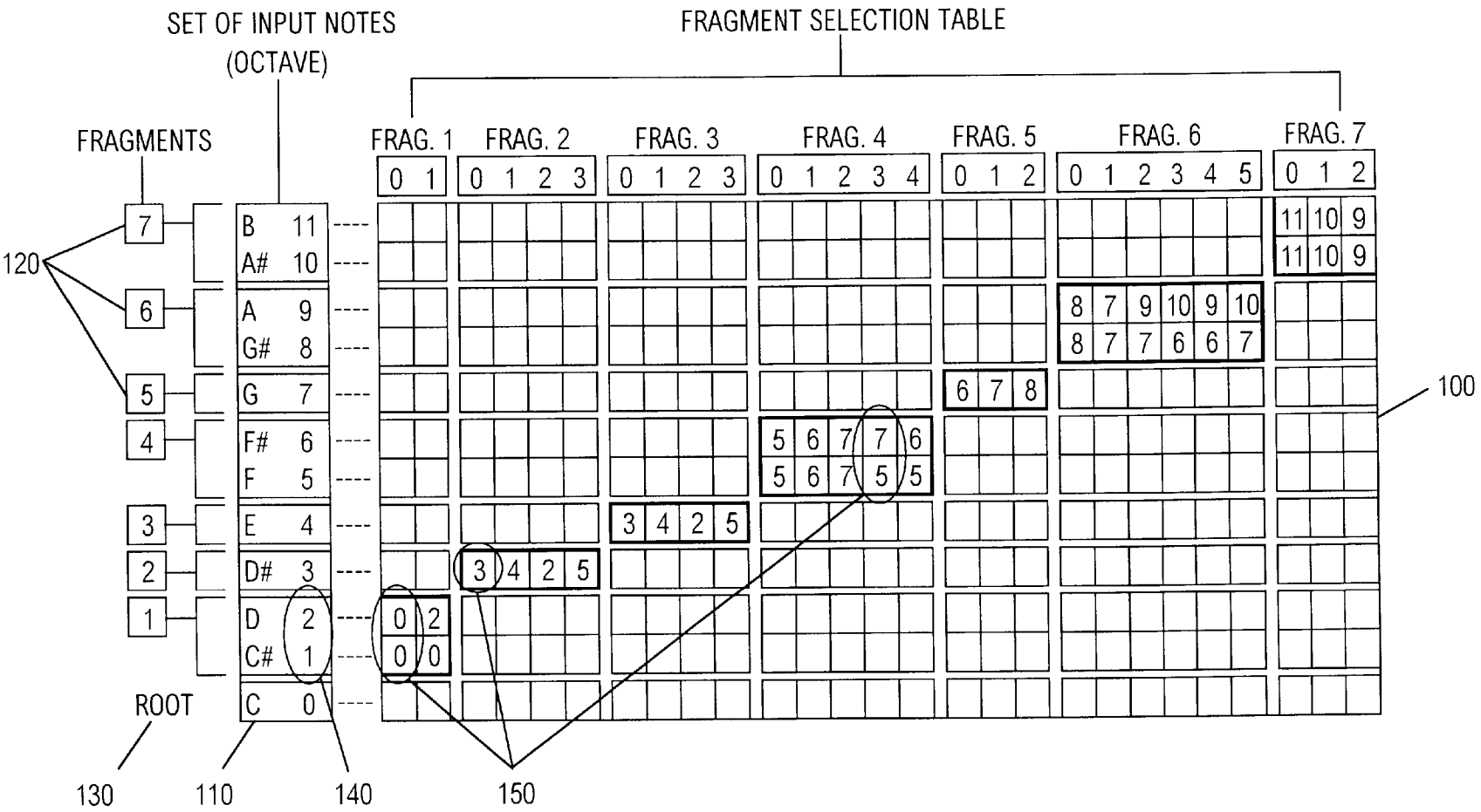
FIG. 1 illustrates a division of an input set of notes into fragments, according to a preferred embodiment of the invention.

The MIDI (Musical Instrument Digital Interface) standard allows for the representation of musical performance information as electronic data, capable of being read by computers, electronic musical instruments, and other devices equipped to do so. There are seven full octaves and three additional notes on an 88 note keyboard with the notes of each octave denoted as <note> "n" (e.g. C4). The MIDI standard specifies that the pitch of a note is to be represented as a number from 0–127, with C4 (middle C) corresponding to 60, A0 (the lowest note on an 88 note keyboard) corresponding to 21, and C8 (the highest note on an 88 note keyboard) corresponding to 108. The MIDI standard is well-known and has been used in programming the present invention. In lieu of the MIDI standard, other electronic musical standards and conventions could be employed according to the present invention.

There are twelve notes in an octave: {C, C♯, D, D♯, E, F, F♯, G, G♯, A, A♯, and B}, which can be represented mathematically by the corresponding values of {0, 1, 2, 3, 4, 5, 6, 7, 8, 9, 10, 11}. These values are often referred to as pitch classes. Regardless of which octave a note is actually in, its pitch value can be reduced to one of the 12 pitch classes through modulo 12 division of the value. For example, 62 (D4 or D in the fifth octave relative to 0) and 86 (D6 or D in the seventh octave) both yield the value 2 (D) when divided by modulo 12. Likewise, standard integer division of a pitch number by 12 will reveal the octave. For example, INT (62/12)=5 (D4 is in the 5th octave relative to 0). Mathematically, the key of C is denoted by the root pitch value 0. Notes in a key other than C may be transposed to that key by subtracting the root pitch class from every note. For example, if the root is known to be F (5), then subtracting 5 from each pitch value will place it in the key of C.

A set of notes may be created comprising these 12 values. Further, pitch classes greater than 11 or less than 0 can be used to indicated the same 12 notes in higher or lower octaves respectively. An example set of notes spanning three octaves may take the form {−12, −11, −10, −9, −8, −7, −6, −5, −4, −3, −2, −1, 0, 1, 2, 3, 4, 5, 6, 7, 8, 9, 10, 11, 12, 13, 14, 15, 16, 17, 18, 19, 20, 21, 22, 23}, where −1 indicates a B which is one octave lower than the B note indicated by 11, and 23 indicates a B which is one octave higher than the B note indicated by 11. Typically, for any given chord type, only a subset of the notes of the full set are utilized, with the remaining notes not being in the scale of the chord. For example, a C Major chord may contain the notes {C, E, and G} or {0, 4, 7}. A scale which is consonant with this chord may contain the notes {C, D, E, G, and A} or {0, 2, 4, 7, 9}. The same chord above, voiced over a two octave range, may be specified as {C, G, and E (+8va)} or {0, 7, 16}; a scale which is consonant with this chord may be specified as covering two octaves, such as {0, 2, 4, 7, 9, 12, 14, 16, 19, 21}. In either case, C♯ or note 1 is not in the scale. Therefore, if the input set of notes contains a C♯ or 1, the conversion algorithm would typically convert the note to a note within the chord scale.

The following discussion will continue with the presumed key of C, although those of skill in the art will recognize that other keys could be used by applying appropriate, known algorithms. Similarly, there are a finite number of conventional chords of musical interest, although those of skill in the art will recognize that other chords may be employed by using similar techniques. For the chords of interest, there may be several notes in common. For example, scales consonant with several major chords (e.g. Major, Major 6th, Major 7th) may contain a G and an A, while several minor chords (e.g. Minor, Minor 6th, Minor 7th) may contain an F and a G. None of the scales have a C♯ note.

Taking advantage of the fact that chords share notes, a set of input notes is divided into a number of fragments consisting of one or more notes. Each note of a fragment is mapped into a note of a set of output notes. Collectively, all of the fragments provide a conversion for every note of the set of input notes. If desired, the fragments could span a group of notes encompassing two, three, or more octaves, or some fraction thereof, independently of the set of input notes. For example, the set of input notes might comprise an octave or portion thereof, while the set of output notes might comprise two or three octaves, or vice versa.

In the following discussion both the set of input notes and set of output notes have arbitrarily been decided to span an octave. However, ranges other than an octave may be employed as previously described. Furthermore, the root (note 0) has been separated consistently from the fragments; however, alternately it may be included as a fragment or part of a fragment.

FIG. 1 shows a fragment selection table 100, having a set of input notes 110 corresponding to an octave, arbitrarily subdivided into a root (note 0) 130 and seven fragments 120, each fragment consisting of one or more notes 140. For each of the seven fragments, there are one or more fragment selection sets 150, shown in table form. By way of example, fragment selection set 0 for fragment 1 dictates that the input of a either a C♯ or a D {1, 2} will result in a C {0, 01,} while fragment selection set 1 results in a C and D {0, 2}. The fragment selection sets thus offer one or more choices of resultant output notes for each fragment of the input notes.

For each chord type to be utilized, a scale of valid notes can be determined, and the fragment selection sets set accordingly. Therefore, for each fragment there will be one valid fragment selection and corresponding fragment selection set for a given chord type. The number of fragment selection sets for each fragment, and the specific designations are user defined and can be fixed or altered as desired.

Figure 2:
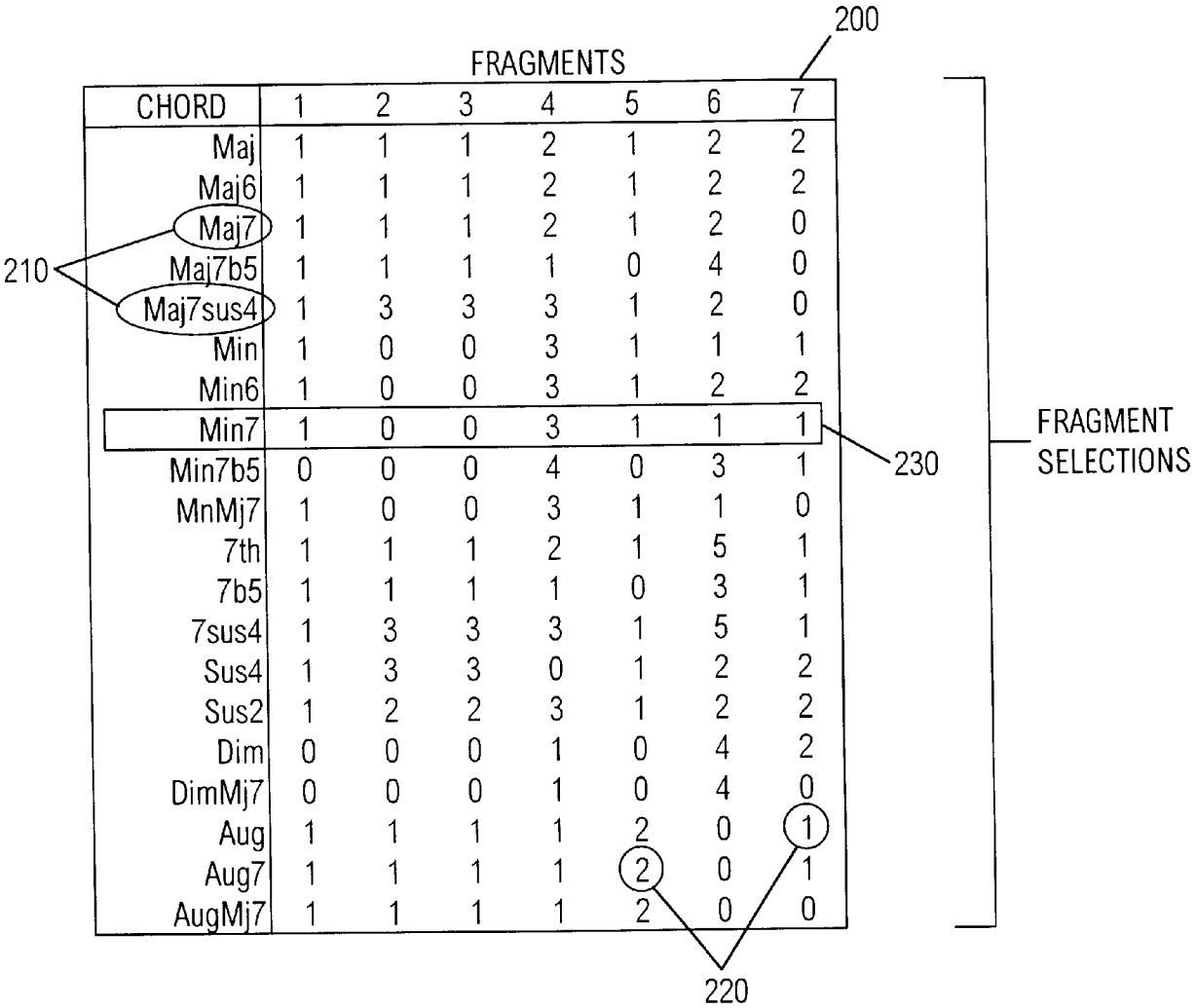
FIG. 2 shows a table of chords and their respective fragment selections.

Once the desired possibilities for fragment selections are determined, a fragment selection matrix 200 can be assembled, as shown in FIG. 2. The column on the left side of the table lists the chord types of interest 210 while the entries designate the fragment selections that will be used 220. For example, the Minor 7th chord (Min7) 230 uses fragment selections {1, 0, 0, 3, 1, 1, 1} from fragments {1, 2, 3, 4, 5, 6, 7}, respectively. One of the chords in the fragment selection matrix may be specified to be a default chord, which will be selected upon system initialization or when no other means of selection is provided.

Figure 3:
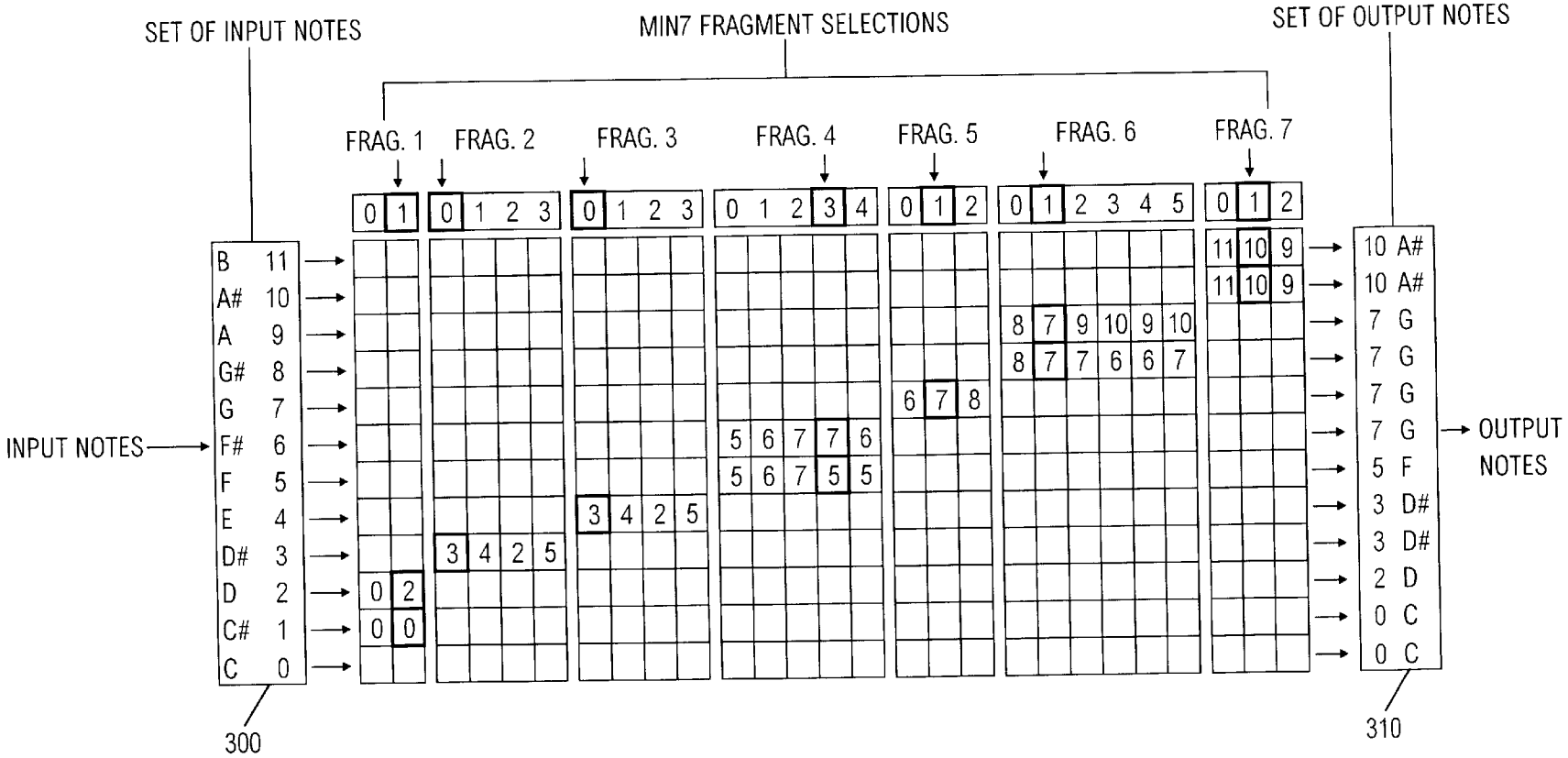
FIG. 3 shows an example of a dynamic conversion table.

FIG. 3 shows the resultant input-output conversion table for the above described fragment selections. In particular, the Min7 fragment selections {1, 0, 0, 3, 1, 1, 1} are shown for fragments 1 through 7. Therefore, selection of any note in the set of input notes 300 (in this example {C, C♯, D, D♯, E, F, F♯, G, G♯, A, A♯,B} will result in a note selected from the set of output notes 310 (in this example {C, D, D♯, F, G, A♯}). By way of example, a C♯ (1) in the set of input notes will utilize fragment selection 1 for fragment 1, resulting in a C (0) in the set of output notes. An F♯ (6) in the set of input notes will utilize fragment selection 3 for fragment 4, resulting in a G (7) in the set of output notes. In this way, every possible input note in the set of input notes is mapped into the desired set of output notes for the chord.

The chord type can be determined using well-know techniques of chord analysis, or arbitrarily selected and then applied to the table in FIG. 2, which determines which fragment selections for each fragment are used. All input notes are then converted using the requested fragment selection sets.

The foregoing description accounts for notes within a desired chord or scale. Occasionally, the user may wish to allow the creation of output notes that are not within the chord or scale. Some of these notes may be considered valid non-chordal notes (e.g. tensions); others may be considered invalid non-chordal notes. When a chord is determined, either by analysis or selection, valid tensions for the chord type can be determined, in addition to other non-chordal notes that may not be considered valid. For example, if the notes {C, C♯, E, G, A♯} or ({0, 1, 4, 7, 10}) are analyzed, it can be determined that the basic chord type is a C7th, and a valid tension note of a C♯ (♭9) is present, comprising the chord C7♭9. For this chord, the fragment selection set can be optionally overridden to provide a ♭9 output note. In the event a non-chordal or invalid tension note is desired, the fragment selection set can also be optionally overridden.

Figure 4:
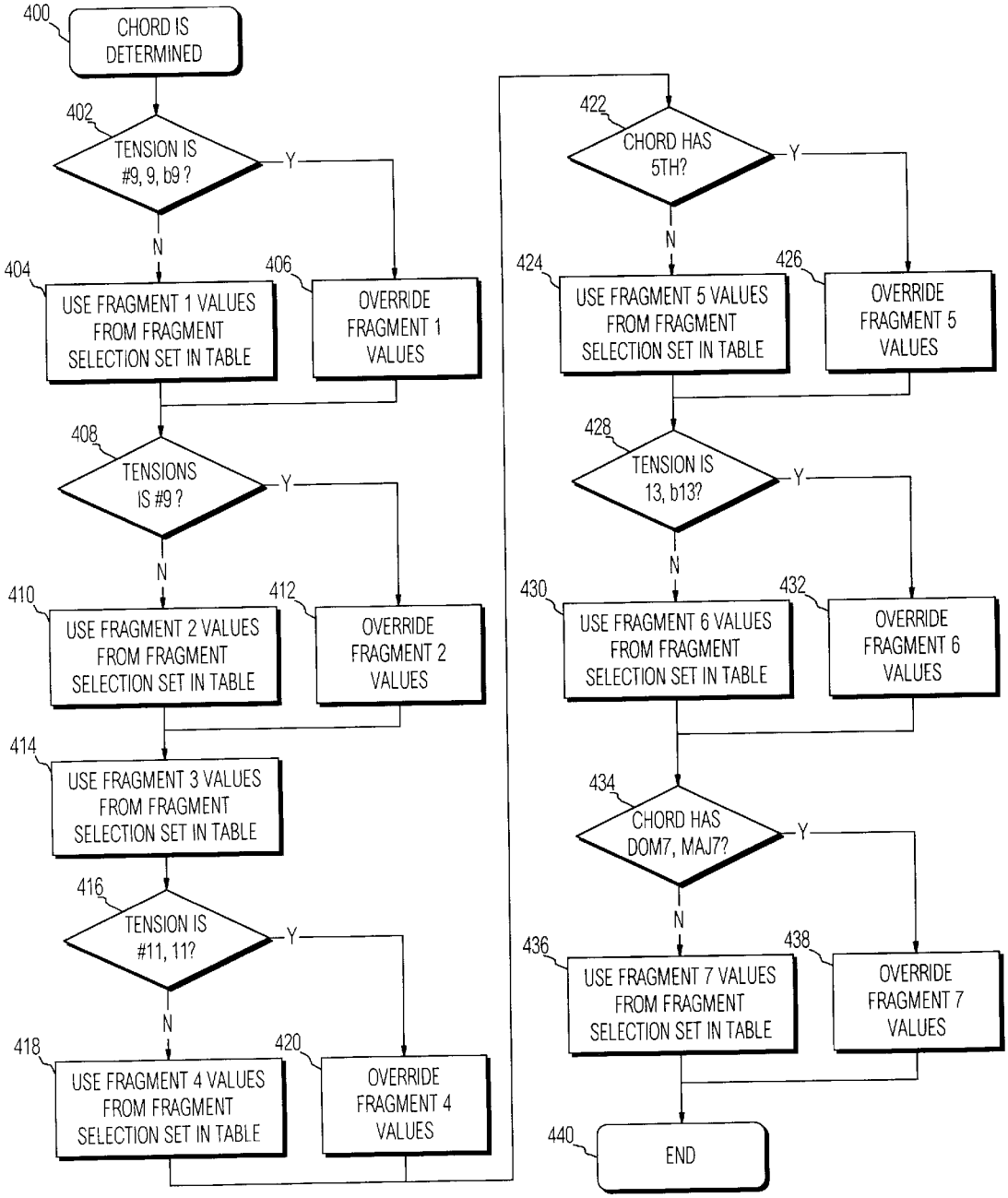
FIG. 4 is a flowchart illustrating a method of overriding fragment selections according to one embodiment of the invention.

One method for overriding the fragment selections is shown in FIG. 4, which illustrates in flowchart form the pseudo-code included as Appendix A. The steps outlined also provide for arbitrary overrides for a fifth, a dominant seventh, and a major seventh, since the user may wish to include these tones in a chord that normally may not contain them. Examples might be the inclusion of a dominant 7th in a Maj7 chord, or the inclusion of a 5th in a Min7♭5 chord.

Referring to FIG. 4, when a chord is determined, either by analysis or selection 400, various information can be determined such as the exact notes present in the chord. If it is determined that the chord contains a tension 402 of a ♯9, 9, or ♭9, the fragment 1 values may be overridden 406. This may be done by specifying directly the output notes for the fragment 1 input notes as shown in the pseudo-code of Appendix A. If the chord does not contain any of these tensions, the fragment selection for fragment 1 of the particular chord type is utilized as previously explained 404. Steps 408 through 412 of FIG. 4 operate in a similar fashion. In this example, the values for fragment 3 are always used 414, and as such, no override is provided. Steps 416 through 420 operate as previously described. At step 422, the presence of a fifth is checked for in the chord. If present, the fragment 5 value may be overridden by specifying directly the output note for the fragment input note. All of the other tests in FIG. 4 operate in a similar fashion. Each fragment may have an override, such as steps 402–406, or may have no override such as step 414 as desired.

The fragment selection table, fragment selection matrix, conversion table and any optional override values may be copied, programmed, or otherwise stored in an electronic memory or buffer. These values may be read from or written to as needed in performing the steps of the conversion. Optionally, a temporary conversion table may be may be created to hold only the input-output sets of notes as overridden by the optional override values. Then, the input notes are applied to the temporary conversion table, yielding the output notes. Alternately, the output notes may be selected from the input-output table shown in FIG. 3 as modified by the optional override values.

Figure 5:
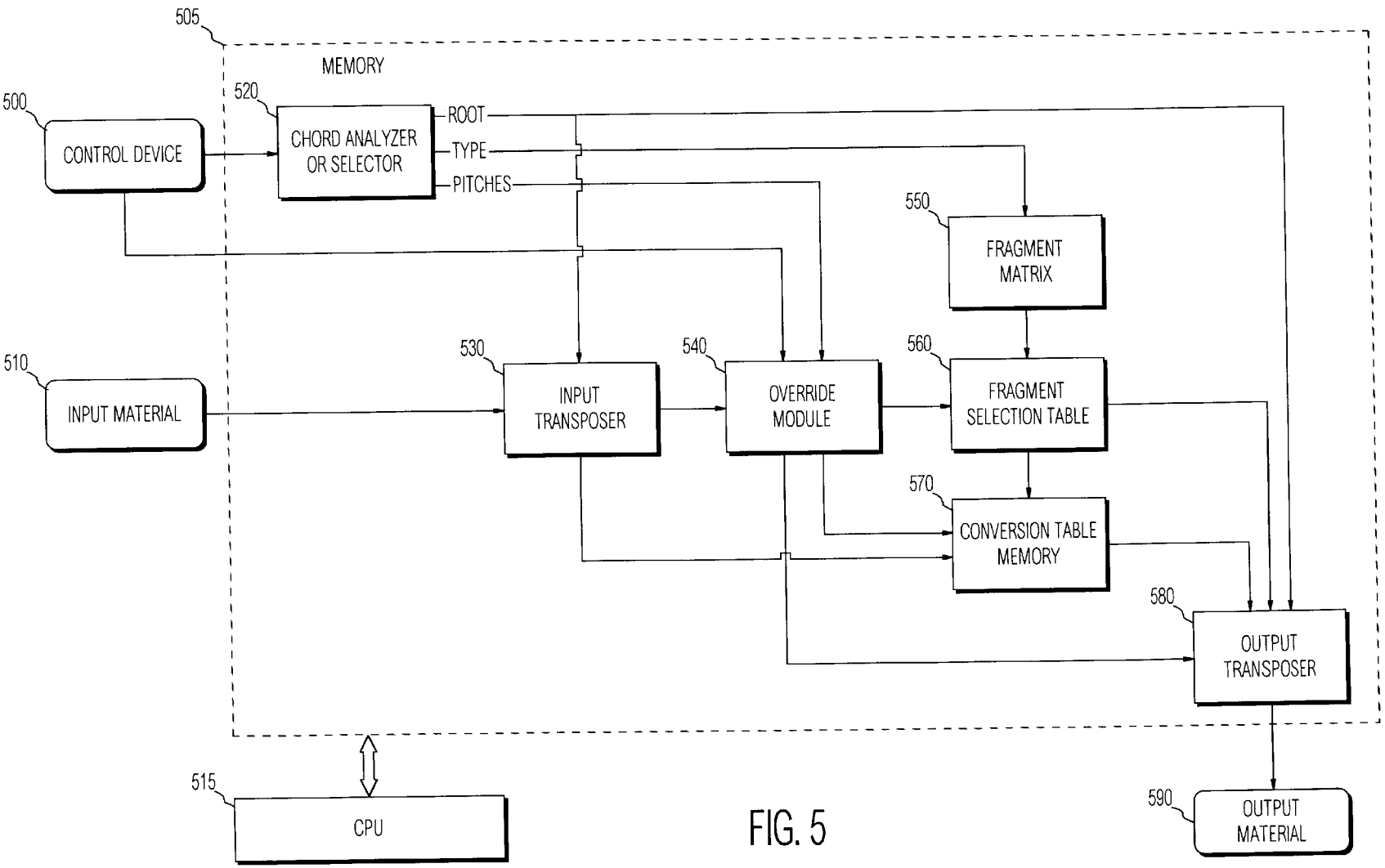
FIG. 5 is a block diagram of the dynamic conversion system according to the one embodiment of the invention.

An electronic musical conversion system according to a preferred embodiment is shown in FIG. 5. An overall memory of sufficient size is provided 505, within which various parts of the processing are performed by a CPU of sufficient processing power 515. A keyboard, a control area of a keyboard, or some other suitable control device 500 provides control notes contained within the input chord which are analyzed by a chord analyzer 520 to determine the root, chord type, and pitches representing valid tensions and non-chordal tones. Chord analyzers are well known, as exemplified by that included in the Korg i-Series. Alternately, chord analyzer 520 may be a chord selector, where buttons or other user operated controls, or the occurrence of certain types of data in incoming MIDI data from the control device cause the selection of a root, chord type, and predetermined pitches associated with the chord.

Musical input material is supplied 510 which may be notes from another area of a keyboard, or the output of a note generation algorithm, or a different control device, such as an internal or external musical file playback system that is generating musical data. Input transposer 530 takes the notes and transposes them to the key of C based on the root determined by chord analyzer 520. They are also reduced to their base pitch classes by modulo 12 division, while retaining the octave of each note for later use by output transposer 580.

The chord type determined by chord analyzer or selector 520 is applied to fragment selector matrix 550, which embodies the information in FIG. 2. The output of fragment selector matrix 550 is applied to fragment selection table 560, which provides the fragment selections shown in FIG. 1. If desired, an optional override module 540 utilizes the information of the pitches in the chord from the chord analyzer or selector 520, and provides the override values for those otherwise provided by fragment selection table 560. Override module 540 may also be controlled directly by control device 500. As desired, a conversion table memory 570 can accept the output of fragment selection table 560 and override module 540, or can be utilized directly.

If conversion table memory is utilized, the notes from input transposer 530 are then applied to the memory 570 to produce output notes. Otherwise the input notes are provided directly to override module 540 if included, and fragment selection table 560. An output transposer 580 takes the output of the optional override module 540 and fragment table 560 (if used directly), or the conversion table memory 570 and, using the root output of chord analyzer or selector 520, transposes the output notes back to the original key and octave, providing the fully-converted output musical material 590. The transposers and tables can use a different root or key reference other than C if desired. Alternately, the operative octave can be changed in override module 540 and fragment table 560 to conform to the current key, obviating the need for transposition to another key.

While the previous example shows the use of overrides for both tension notes and non-chordal notes, the overrides could be utilized only for non-chordal notes if desired, with additional fragment selections being provided in FIG. 1 to handle tension notes, and additional chord types including tension notes added to FIG. 2 (e.g. C7♭9♯11). The pseudo-code of Appendix A shows that when two valid tension types are determined in the same chord (e.g. both ♭9 and ♯9) the higher one is given a priority. A person skilled in the art will recognize that other arrangements are possible.

DETAILED DESCRIPTION OF A SECOND EMBODIMENT

The sets of input and output notes utilized need not conform to values derived from note numbers by modulo 12 division as shown in the previous example. A set of notes may be constructed from absolute MIDI values, such as {60, 61, 62, 63, 64, 65, 66, 67, 68, 69, 70, 71}, which specifies the 5th octave of notes from C to B. Furthermore, the input and output sets of notes may comprise all 128 MIDI pitches (0–127) if desired, or subsets of one or more of those notes (such as the 5th octave just described). The notes in the subsets may be adjacent or non-adjacent pitches. Any notes in the input material not belonging to the set of input notes may be passed to the output material without conversion.

It may be desirable to convert different subsets of the set of input notes to notes in the set of output notes, in different combinations. Each such desired combination of conversions shall be referred to as a conversion map. Taking advantage of the fact that some desired conversion maps share notes or combinations of notes, a set of input notes is divided into a number of fragments as previously described.

The General MIDI System Level 1 Specification ("GM"), published by the MIDI Manufacturers Association, is well-known in the music industry. According to this specification, a MIDI number is specified for drum sounds, where specific note values represent specific drum sounds, such as 36 being a kick drum, and 38 being a snare drum. While the following example uses this convention for specifying drum notes, other conventions could be used instead. Furthermore, while the following example utilizes drum notes according to the GM drum maps, the notes could also be musical notes, and play sounds from any instrument.

Figure 6:
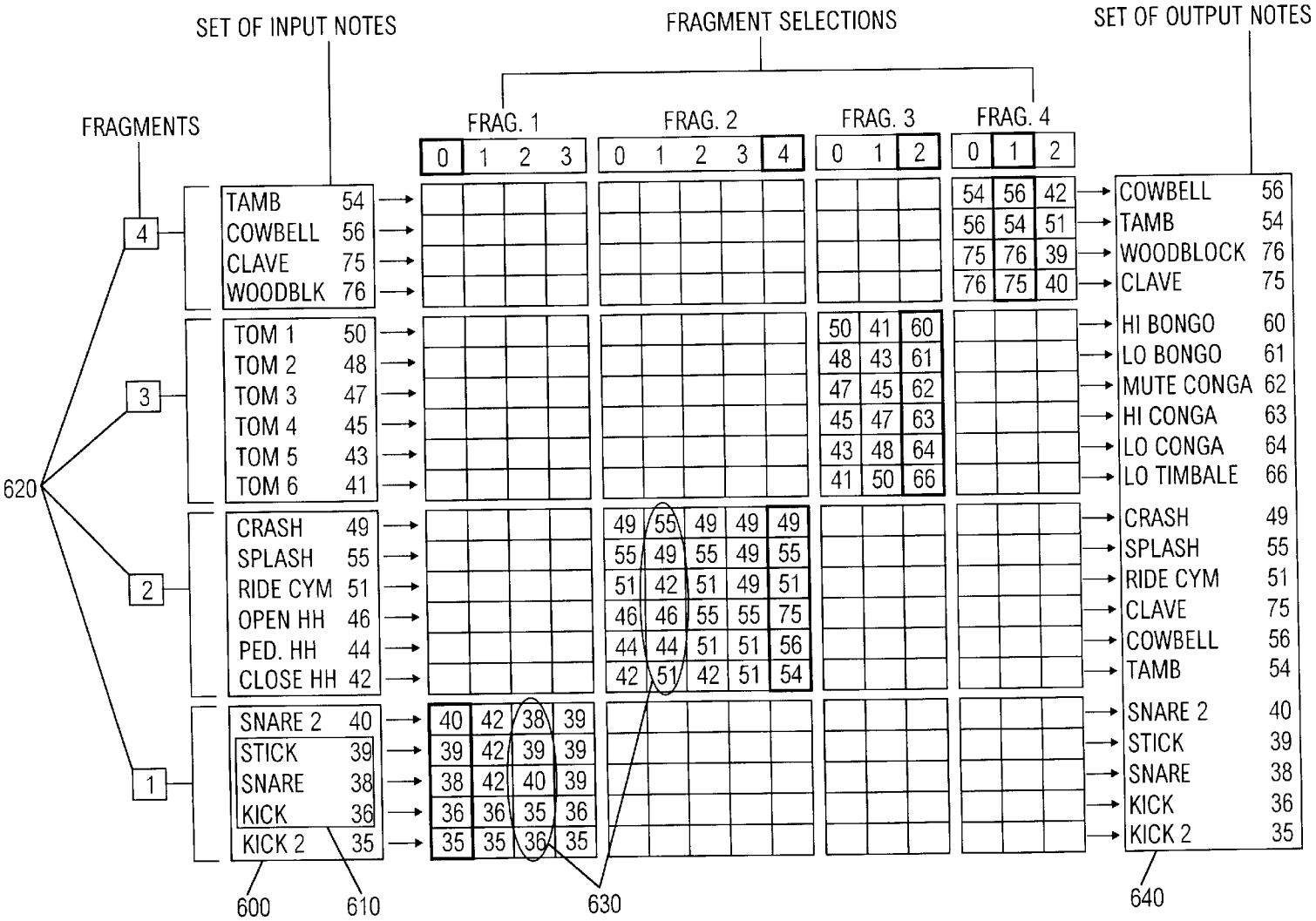
FIG. 6 is a diagram illustrating the division of an input set of notes into fragments, and a table of fragments, according to one embodiment of the invention.

FIG. 6 shows a set of input notes 600 consisting of 21 adjacent and/or non-adjacent drum notes 610, arbitrarily divided into four fragments 620. For each of the four fragments, there are one or more fragment selection sets shown in table form 630. For each conversion map to be utilized, the desired notes are determined, and the fragment selection sets set accordingly. Therefore, for each fragment there will be one valid fragment selection and corresponding fragment selection set for a given map. The number of fragment selection sets for each fragment, and the specific designations are user defined and can be fixed or altered as desired.

As demonstrated in this example, a fragment selection set may contain notes in the output set of notes 640 not present in the fragment of the set of input notes. For example, while fragment 4 of the set of input notes contains {54, 56, 75, 76}, fragment selection set 2 for fragment 4 contains {42, 51, 39, 40}, which are values present in fragments 1 and 2 of the set of input notes. Also as shown, a fragment selection may contain output notes which are not included in the set of input notes whatsoever. For example, while fragment 3 of the set of input notes contains {50, 48, 47, 45, 43, 41}, fragment selection set 2 for fragment 3 contains {60, 61, 62, 63, 64, 66}, none of which are present in the shown set of input notes.

Once the desired possibilities for fragment selections are determined, a fragment selection matrix can be assembled, as shown in FIG. 7, 700. The column on the left side of the table lists the available conversion maps 710, while the table entries designate the fragment selection sets that will be used 720. For example, map 28, 730, uses fragment selections {0, 4, 2, 1} from fragments {1, 2, 3, 4} respectively. One of the maps in the fragment selection matrix may be specified to be a default map, which will be selected upon system initialization or when no other means of selection is provided.

Referring back to FIG. 6, the result of utilizing map 28 {0, 4, 2, 1} is shown highlighted for fragments 1 through 4. Selection of any note in the set of input notes will result in a note selected from the set of output notes. By way of example, a tambourine (tamb—54) in the set of input notes will utilize fragment selection set 1 for fragment 4, resulting in a cowbell (cowbell—56) in the set of output notes.

The conversion map can be arbitrarily selected by any means and then applied to the table in FIG. 6, which determines which fragment selection sets for each fragment are used. All input notes in the set of input notes are then converted using the requested fragment selection sets. Any notes in the input material which are not in the set of input notes may be passed to the output material without conversion, or alternately suppressed and not issued.

If desired, the set of input notes and fragment selection sets can be copied into an electronic memory which holds the values fixed by the fragment selection sets, essentially creating a temporary conversion table. Then, the input notes are applied to the memory, yielding the output notes. Alternately, the input notes can be applied directly to the fragment selection table of FIG. 6 to produce the output notes.

Figure 8:
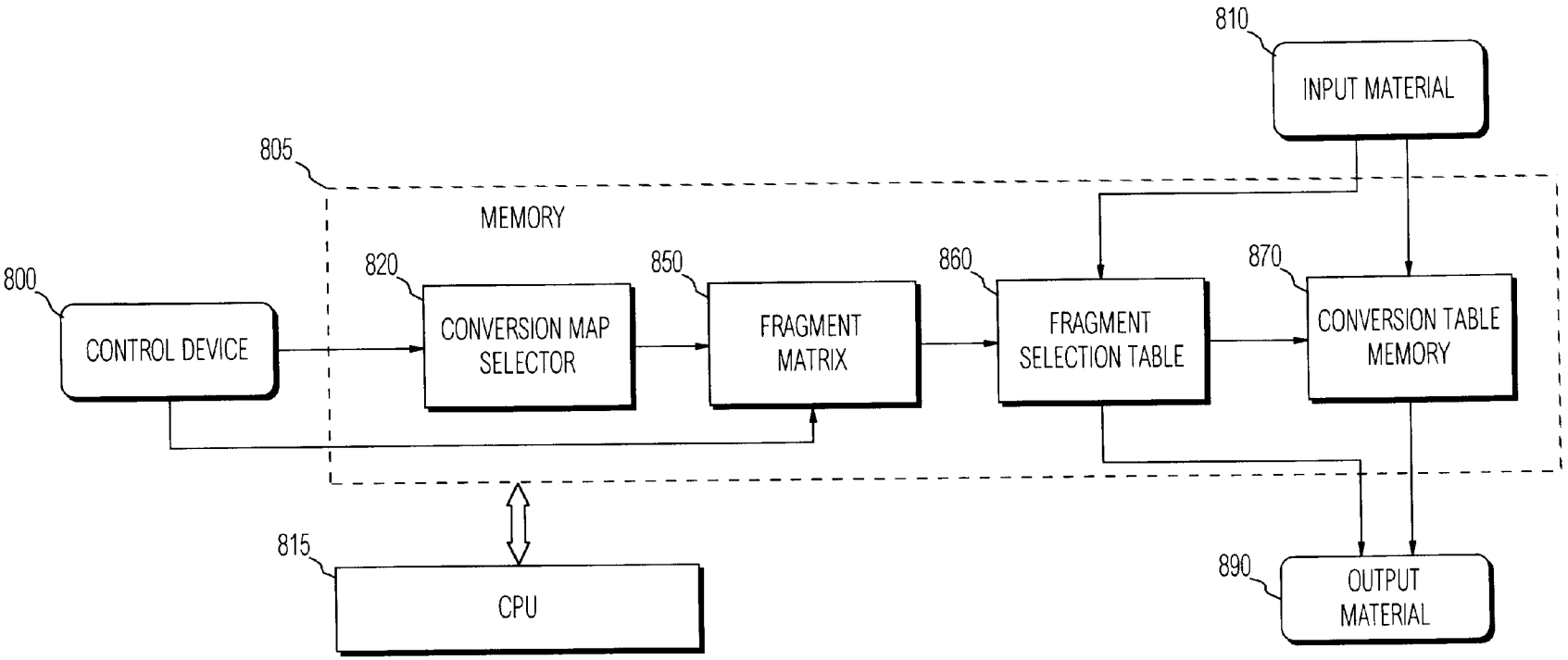
FIG. 8 is a block diagram of the dynamic conversion system according to a second embodiment.

An electronic musical conversion system according to a second embodiment is shown in FIG. 8. An overall memory of sufficient size is provided 805 within which various parts of the processing are performed by a CPU of sufficient processing power 815. A keyboard, drum machine, or other suitable control device 800 provides user operated controls which are used to select a conversion map 820. Alternately, the conversion map may be selected by other means, such as the occurrence of certain types of data in incoming MIDI data from the control device which cause the selection of a conversion map.

The conversion map selector 820 is applied to fragment selection matrix 850, which contains the information in FIG. 7. The output of fragment selector 850 is applied to fragment selection table 860, which provides the fragment selection sets shown in FIG. 6. The control device 800 may also be used to individually and selectively change fragment selections within the conversion map of fragment matrix 850. As desired, a conversion table memory 870 can accept the output of the fragment selection table 860, or their output can be used directly.

Musical input material is supplied 810, which may be notes from a keyboard, or the output of a note generation algorithm, or a different control device, such as an internal or external musical file playback system that is generating musical data.

If a conversion table memory is utilized, the notes from the input material 810 are then applied to conversion memory 870 to produce converted output material 890; otherwise the input notes are provided directly to fragment selection table 860, providing the converted output material 890.

It may be seen that the chord analyzer or selector, input and output transposers and optional override module of the first embodiment could be utilized in combination with the second embodiment, and the conversion maps of the second embodiment selected based on chord analysis or chord selection rather than arbitrary selection.

The methods and devices of the present invention may receive MIDI notes and data from an external device, and produce MIDI data that is sent out to the same or different external MIDI device containing a tone generator where the data produces audio output. Alternately, the methods and devices of the present invention may also be incorporated into such devices in any number of combinations, including a device with a keyboard, a MIDI guitar, a device with pads, switches or buttons, or any or all such devices also in conjunction with an internal tone generator. Such an apparatus may include a general purpose computer programmed to perform the method or dedicated hardware specifically configured to perform the process. Moreover, the method and hardware may be used in a stand-alone fashion or as part of a system. Further, electronic musical standards other than the MIDI conventions could be employed according to the present invention.

While the particular embodiments and methods of the invention have been shown and described, it will be obvious to those skilled in the art that the specific terms and figures are employed in a generic and descriptive sense only and not for the purposes of limiting or reducing the scope of the broader inventive aspects herein. By disclosing the preferred embodiments and steps of the present invention above, it is not intended to limit or reduce the scope of coverage for the general applicability of the present invention. Persons of skill in the art will easily recognize the substitution of similar components and steps in the apparatus and methods of the present invention.

APPENDIX A

```
FRAGMENT 1
if (tension has #9) {
    if (chord contains b9)
        input note 1 -> output note 1;
    else
        input note 1-> output note 0;
    if (chord contains 9)
        input note 2 -> output note 2;
    else
```

-continued

APPENDIX A

```
        input note 2 -> output note 3;
}else if (tension has 9) {
    if (chord contains b9)
        input note 1 -> output note 1;
    else
        input note 1 -> output note 2;
    input note 2 -> output note 2;
}else if (tension has b9) {
    input note 1 -> output note 1;
    if (chord contains 9)
        input note 2 -> output note 2;
    else
        input note 2 -> output note 1;
}else{
    input note 1 -> fragment 1 selection for input note 1;
    input note 2 -> fragment 1 selection for input note 2;
}
FRAGMENT 2:
if (tension has #9) {
    input note 3 -> output note 3;
}else{
    input note 3 -> fragment 2 selection;
}
FRAGMENT 3:
use fragment 3 selection;
FRAGMENT 4:
if(tension has #11){
    if (chord contains 11)
        input note 5 -> output note 5;
    else
        input note 5 -> output note 6;
    input note 6 -> output note 6;
}else if(tension has 11){
    input note 5 -> output note 5;
    if(chord contains #11)
        input note 6 -> output note 6;
    else
        input note 6 -> output note 5;
}else{
    input note 5 -> fragment 4 selection for input note 5;
    input note 6 -> fragment 4 selection for input note 6;
}
FRAGMENT 5:
if (chord contains 5th)
    input note 7 -> output note 7;
else{
    input note 7 -> fragment 5 selection;
}
FRAGMENT 6:
if(tension has 13){
    if(chord contains b13)
        input note 8 -> output note 8;
    else
        input note 8 -> output note 9;
    input note 9 -> output note 9;
}else if(tension has b13){
    input note 8 -> output note 8;
    if(chord contains 13)
        input note 9 -> output note 9;
    else
        input note 9 -> output note 8;
}else{
    input note 8 -> fragment 6 selection for input note 8;
    input note 9 -> fragment 6 selection for input note 9;
}
FRAGMENT 7:
if (chord contains Dom7)
    input note 10 -> output note 10;
else{
    input note 10 -> fragment 7 selection for input note 10;
}
if(chord contains Maj7)
    inputnote 11 -> outputnote 11;
else{
    input note 11 -> fragment 7 selection for input note 11;
}
```

What is claimed is:

1. A general purpose computer-based musical conversion system for converting musical notes comprising:

a musical input device;

a musical output device;

a set of available input notes from said musical input device;

a set of input notes comprising a subset of said set of available input notes;

a set of available output notes;

a set of fragments, each of said fragments containing at least one note of said set of input notes;

a fragment selection table, said fragment selection table including at least one fragment selection set for each fragment, each of said fragment selection sets comprising notes of said set of available set of output notes wherein each input note of said fragments is correlated with exactly one of said set of available output notes;

a fragment selection matrix including at least one map of valid fragment selections, each of said valid fragment selections indicating one of said fragment selection sets for each of said fragments;

a map selector for selecting said map, and a set of selected output notes, said set of selected output notes comprising a subset of said set of available output notes resulting from the selection of one of said maps, said set of selected output notes being applied to said musical output device in response to said set of input notes being applied to said musical input device.

2. The general purpose computer-based musical conversion system of claim 1 wherein said map of valid fragment selections indicates fragment selection sets containing notes of said set of available output notes corresponding to a chord.

3. The general purpose computer-based musical conversion system of claim 1 wherein said map of valid fragment selections indicates fragment selection sets containing notes of said set of available output notes corresponding to percussion sounds.

4. The general purpose computer-based musical conversion system of claim 1 wherein said set of input notes and said set of selected output notes are represented in a MIDI format.

5. The general purpose computer-based musical conversion system of claim 1 wherein said musical input device and said musical output device are MIDI compatible.

6. The general purpose computer-based musical conversion system of claim 1 further comprising an unaltered set of notes, said unaltered set of notes comprising a subset of said set of available input notes, said unaltered set of notes being transmitted from said musical input device to said musical output device without being converted.

7. The general purpose computer-based musical conversion system of claim 1 further comprising at least one user-operated fragment set selector for independently adjusting at least one of said valid fragment selections in said map.

8. The general purpose computer-based musical conversion system of claim 7 wherein said fragment set selector is a selector switch on a musical instrument.

9. The general purpose computer-based musical conversion system of claim 1 further comprising:

an input transposer for normalizing said set of available input notes to a set of pitch classes wherein said pitch classes comprise said set of input notes and said notes of said fragment selection sets, and an output transposer for denormalizing said set of selected output notes.

10. The general purpose computer-based musical conversion system of claim 9 wherein said set of pitch classes represents a musical octave.

11. The general purpose computer-based musical conversion system of claim 1 wherein said map selector comprises a control device, one or more control notes being input to said musical conversion system through said control device.

12. The general purpose computer-based musical conversion system of claim 11 wherein said control device further includes a chord analyzer, said chord analyzer determining a chord of said input control notes and selecting said map based on said chord.

13. The general purpose computer-based musical conversion system of claim 12 wherein said chord analyzer also determines a root, a set of valid tensions and a set of pitches comprising said chord.

14. The general purpose computer-based musical conversion system of claim 13 further comprising:

an input transposer for transposing said set of available input notes from a first key to a second key, wherein said set of input notes and said notes of said fragment selection sets are in said second key, and an output transposer for transposing said set of selected output notes in a second key to a set of available output notes in said first key.

15. The general purpose computer-based musical conversion system of claim 13 further comprising an override module for superseding at least one note of said set of selected output notes based upon said chord, said set of valid tensions, and said set of pitches comprising said chord.

16. The general purpose computer-based musical conversion system of claim 15 further comprising a temporary conversion table for storing said first subset of input notes and said set of selected output notes as superseded by said override module.

17. The general purpose computer-based musical conversion system of claim 1 further comprising a user-operable control device for superseding at least one of said set of selected output notes.

18. The general purpose computer-based musical conversion system of claim 1 wherein said musical conversion system is a component of an electronic keyboard.

19. A general purpose computer-implemented method of musical conversion, said method comprising the steps of:

applying a set of input notes to a musical input;

dividing said set of input notes into fragments, each of said fragments including at least one note of said input set of notes;

creating at least one fragment selection set for each of said fragments;

mapping an output note within each fragment selection set to each of said input notes of said associated fragments;

creating a fragment selection matrix including at least one map, said map including a set of valid fragment selections, each of said valid fragment selections indicating one of said fragment selection sets for each of said fragments;

selecting one of said maps so as to determine a set of selected output notes, and applying said selected set of output notes to a musical output in response to said set of input notes.

20. The general purpose computer-implemented method of musical conversion of claim 19 wherein said step of selecting further comprises the step of selecting a default map.

21. The general purpose computer-implemented method of musical conversion of claim 19 wherein said step of dividing said set of input notes into fragments further comprises the steps of:

determining a subset of available input notes associated with a chord, and mapping said subset of available input notes to said set of input notes based on said chord.

22. The general purpose computer-implemented method of musical conversion of claim 19 wherein said step of mapping said output notes further comprises the steps of:

determining a subset of output notes corresponding to a chord from a set of available output notes, and populating each fragment selection set with notes from said subset of output notes.

23. The general purpose computer-implemented method of musical conversion of claim 19 wherein said step of creating said fragment selection matrix further comprises the step of populating said fragment selection matrix with a plurality of maps, each map containing valid fragment selections corresponding to a chord.

24. The general purpose computer-implemented method of musical conversion of claim 19 wherein said step of selecting one of said maps further comprises the steps of:

analyzing control device input notes to determine a chord, and selecting a map corresponding to said chord.

25. The general purpose computer-implemented method of musical conversion of claim 19 further comprising the steps of:

analyzing control device notes to determine a chord of said control device notes, a root of said chord, a set valid tensions of said chord and a set of pitches comprising said chord;

transposing an available set of input notes from a first key to a second key according to said root, said set of input notes comprising a subset of said available entire set of notes in said a second key, and transposing said selected set of output notes in said second key to a set of output notes in said first key.

26. The general purpose computer-implemented method of musical conversion of claim 25 further comprising the step of overriding at least one of said output notes in said fragment selection sets based upon said chord, said set of valid tensions, and said set of pitches.

27. The general purpose computer-implemented method of musical conversion of claim 19 further comprising the steps of:

normalizing a set of available input notes to a set of pitch classes;

creating said set of input notes from said set of pitch classes, and denormalizing said set of selected output notes to a set of available output notes.

28. The general purpose computer-implemented method of musical conversion of claim 19 further comprising the step of overriding at least one of said valid fragment selections in said map so as to select a different fragment selection set within said map.

29. The general purpose computer-implemented method of musical conversion of claim 28 wherein said step of selecting one of said maps further includes the steps of:

storing said set of input notes and said set of selected output notes in a table in a temporary computer memory, and replacing in said temporary memory said overridden output notes.

30. The general purpose computer-implemented method of musical conversion of claim 19 further comprising the steps of:

accepting said set of input notes in MIDI data format at said musical input;

representing said set of input notes and said set of selected output notes in a MIDI data format, and providing said set of selected output notes in MIDI data format at said musical output.

31. The general purpose computer-implemented method of musical conversion of claim 19 wherein said step of applying said set of input notes to said musical input further comprises the steps of:

dividing a set of available input notes into a first and a second subset of input notes, said first subset including said set of input notes, and passing said second subset of available input notes to said musical output unaltered.

32. The general purpose computer-implemented method of musical conversion of claim 31 further comprising the steps of:

accepting a set of available input notes in MIDI data format at said musical input;

representing said set of input notes and said set of selected output notes in a MIDI data format, and providing said second subset of available input notes in MIDI data format at said musical output.

33. The general purpose computer-implemented method of musical conversion of claim 19 wherein said step of selecting one of said maps further comprises the step of storing said set of input notes and said selected set of output notes in a table in a temporary computer memory.

34. A computer-readable medium for storing a set of instructions for controlling a general purpose digital computer, said set of instructions causing said computer to:

accept a set of input notes from a musical input;

divide said set of input notes into fragments, each of said fragments including at least one note of said input set of notes;

create at least one fragment selection set for each of said fragments;

map an output note within each fragment selection set to each of said input notes of said associated fragments;

create a fragment selection matrix including at least one map, said map including a set of valid fragment selections, each of said valid fragment selections indicating one of said fragment selection sets for each of said fragments;

select one of said maps so as to determine a set of selected output notes, and apply said selected set of output notes to a musical output in response to said set of input notes.

* * * * *

UNITED STATES PATENT AND TRADEMARK OFFICE

CERTIFICATE OF CORRECTION

PATENT NO. : 6,084,171

DATED : July 4, 2000

INVENTOR(S) : Kay

It is certified that error appears in the above-identified patent and that said Letters Patent is hereby corrected as shown below:

Col. 1, line 46, after "(11)" insert --,--.

Col. 3, line 29, after "to" delete --the--.

Col. 4, line 67, after "of" delete --a--.

Col. 6, line 24, delete "may be" (second occurrence).

Col. 13, line 34, after "set" insert --of--.

Col. 13, line 40, after "said" delete --a--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*